US008425254B2

(12) United States Patent
Johannes

(10) Patent No.: US 8,425,254 B2
(45) Date of Patent: Apr. 23, 2013

(54) ELECTRICAL CONNECTOR WITH FERRITE BLOCK ASSEMBLY

(75) Inventor: Richard A. Johannes, Lake Orion, MI (US)

(73) Assignee: FCI Automotive Holding (FR)

( * ) Notice: Subject to any disclaimer, the term of this patent is extended or adjusted under 35 U.S.C. 154(b) by 1102 days.

(21) Appl. No.: 11/725,938

(22) Filed: Mar. 19, 2007

(65) Prior Publication Data

US 2008/0233801 A1 Sep. 25, 2008

(51) Int. Cl.
*H01R 13/66* (2006.01)

(52) U.S. Cl.
USPC ..... 439/620.07

(58) Field of Classification Search ..... 439/620.05, 439/620.07
See application file for complete search history.

(56) References Cited

U.S. PATENT DOCUMENTS

| | | | | |
|---|---|---|---|---|
| 4,992,060 | A * | 2/1991 | Meyer | 439/620.21 |
| 5,213,522 | A | 5/1993 | Kojima | 439/620 |
| 5,895,282 | A | 4/1999 | Little | 439/332 |
| 6,089,917 | A * | 7/2000 | Anderson et al. | 439/620.06 |
| 6,152,775 | A | 11/2000 | Pavlovic | 439/620 |
| 6,234,843 | B1 | 5/2001 | Pavlovic | 439/620 |
| 6,283,794 | B1 | 9/2001 | Osuga | 439/620 |
| 6,435,894 | B2 | 8/2002 | Little et al. | 439/352 |
| 6,663,411 | B2 | 12/2003 | Little | 439/352 |
| 6,663,413 | B2 | 12/2003 | Kuhnel | 439/422 |
| 6,743,051 | B2 | 6/2004 | Hayashi | 439/620 |
| 6,799,999 | B2 | 10/2004 | Williamson et al. | 439/676 |
| 6,942,523 | B2 * | 9/2005 | Pavlovic et al. | 439/620.07 |
| 7,121,892 | B2 | 10/2006 | Johannes et al. | 439/620.07 |
| 2005/0280484 | A1 | 12/2005 | McLauchlan et al. | 333/185 |

FOREIGN PATENT DOCUMENTS

| | | |
|---|---|---|
| JP | 5-21113 | 1/1993 |
| JP | 05-021113 A | 1/1993 |
| JP | 09-161899 A | 6/1997 |
| JP | 10144407 | 5/1998 |
| JP | 2002-033153 A | 1/2002 |
| JP | 2003-249308 A | 9/2003 |

* cited by examiner

*Primary Examiner* — Briggitte R Hammond
(74) *Attorney, Agent, or Firm* — Thomas N. Twomey

(57) ABSTRACT

A filtering ferrite block assembly for squib system electrical conductors including a first ferrite block including first conductor channels; and a second ferrite block including second conductor channels. The second ferrite block is adapted to be connected to the first ferrite block with portions of the electrical conductors therebetween. The electrical conductors extend through the first and second conductor channels between the two ferrite blocks.

11 Claims, 7 Drawing Sheets

ELECTRICAL CONNECTOR WITH FERRITE BLOCK ASSEMBLY

BACKGROUND OF THE INVENTION

1. Field of the Invention

The present invention relates to an electrical connector and, more particularly, to an electrical connector having a ferrite block assembly.

2. Brief Description of Prior Developments

U.S. Pat. No. 5,213,522 discloses electrical connectors with ferrite blocks; one of the ferrite blocks having connector pin slots. Ferrite blocks are used in squib electrical connectors as described in U.S. Pat. Nos. 6,152,775 and 6,234,843 for example which are hereby incorporated by reference in their entireties. There is a desire to improve assembly of squib electrical connectors to allow for faster assembly.

SUMMARY OF THE INVENTION

In accordance with one aspect of the present invention, a filtering ferrite block assembly for squib system electrical conductors is provided including a first ferrite block including first conductor channels; and a second ferrite block including second conductor channels. The second ferrite block is adapted to be connected to the first ferrite block with portions of the electrical conductors therebetween. The electrical conductors extend through the first and second conductor channels between the two ferrite blocks.

In accordance with another aspect of the invention, an electrical connector is provided comprising a housing comprising a main section and a cover; electrical contacts connected to the housing; and a ferrite block assembly connected to the housing. The ferrite block assembly comprises two ferrite block members adapted to surround portions of electrical conductors connected to the electrical contacts. The portions of the electrical conductors are located between the ferrite block members. A first one of the ferrite block members is connected to the main section and a second one of the ferrite block members is connected to the cover.

In accordance with another aspect of the invention, a method of assembling an electrical connector is provided comprising providing a first subassembly comprising a housing main section and a first ferrite block member; positioning electrical conductors in first conductor channels of the first ferrite block member; positioning a second ferrite block member onto the first ferrite block member to surround portions of the electrical conductors by the first and second ferrite block members; and connecting a housing cover to the housing main section to retain the first and second ferrite block members together.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
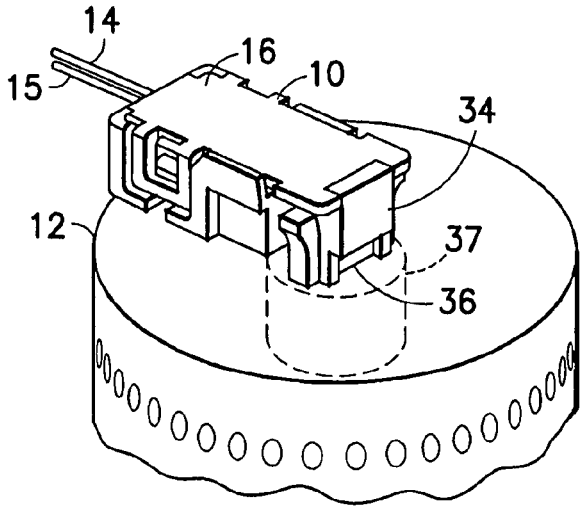
FIG. 1 is a perspective view of an electrical connector incorporating features of the present invention attached to an air bag gas generator.

Referring to FIG. 1, there is shown a perspective view of an exemplary electrical connector 10, incorporating features of the present invention, shown attached to an air bag gas generator 12. In alternate embodiments, the connector 10 could be attached to any suitable type of gas generator or, to any other type of electrical or electronic component. Although the present invention will be described with reference to the exemplary embodiment shown in the drawings, it should be understood that the present invention can be embodied in many alternate forms of embodiments. In addition, any suitable size, shape or type of elements or materials could be used.

Figure 3:
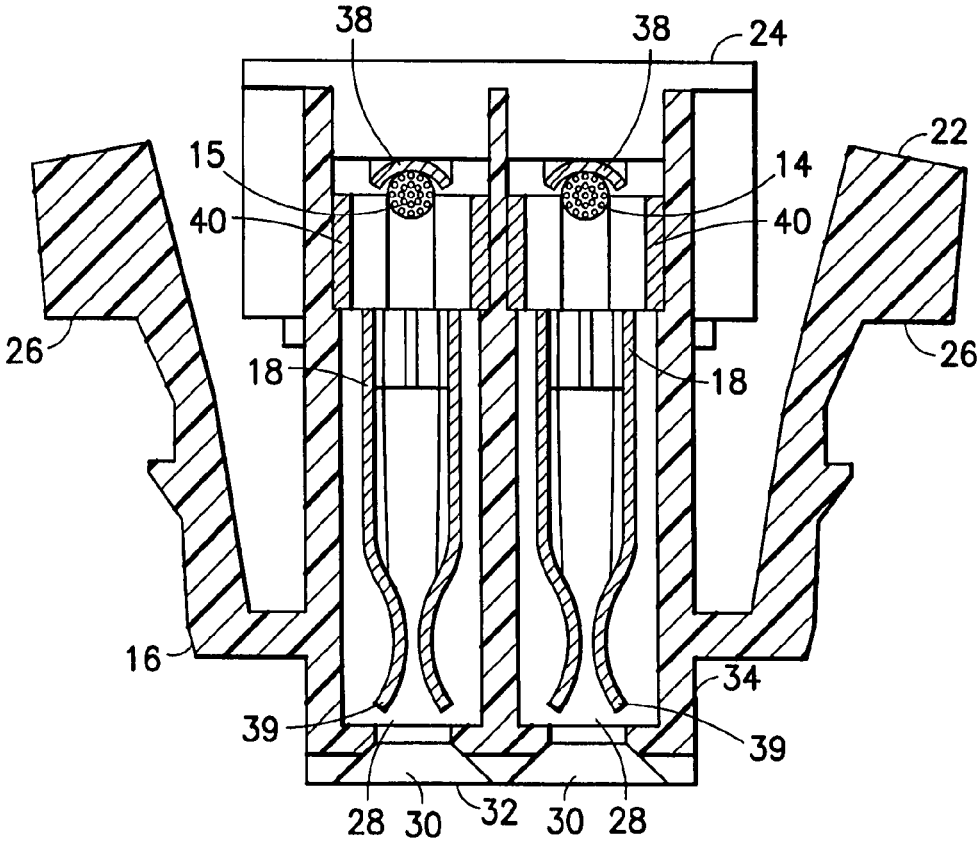
FIG. 3 is a cross-sectional view of the electrical connector shown in FIG. 1.
Figure 2:
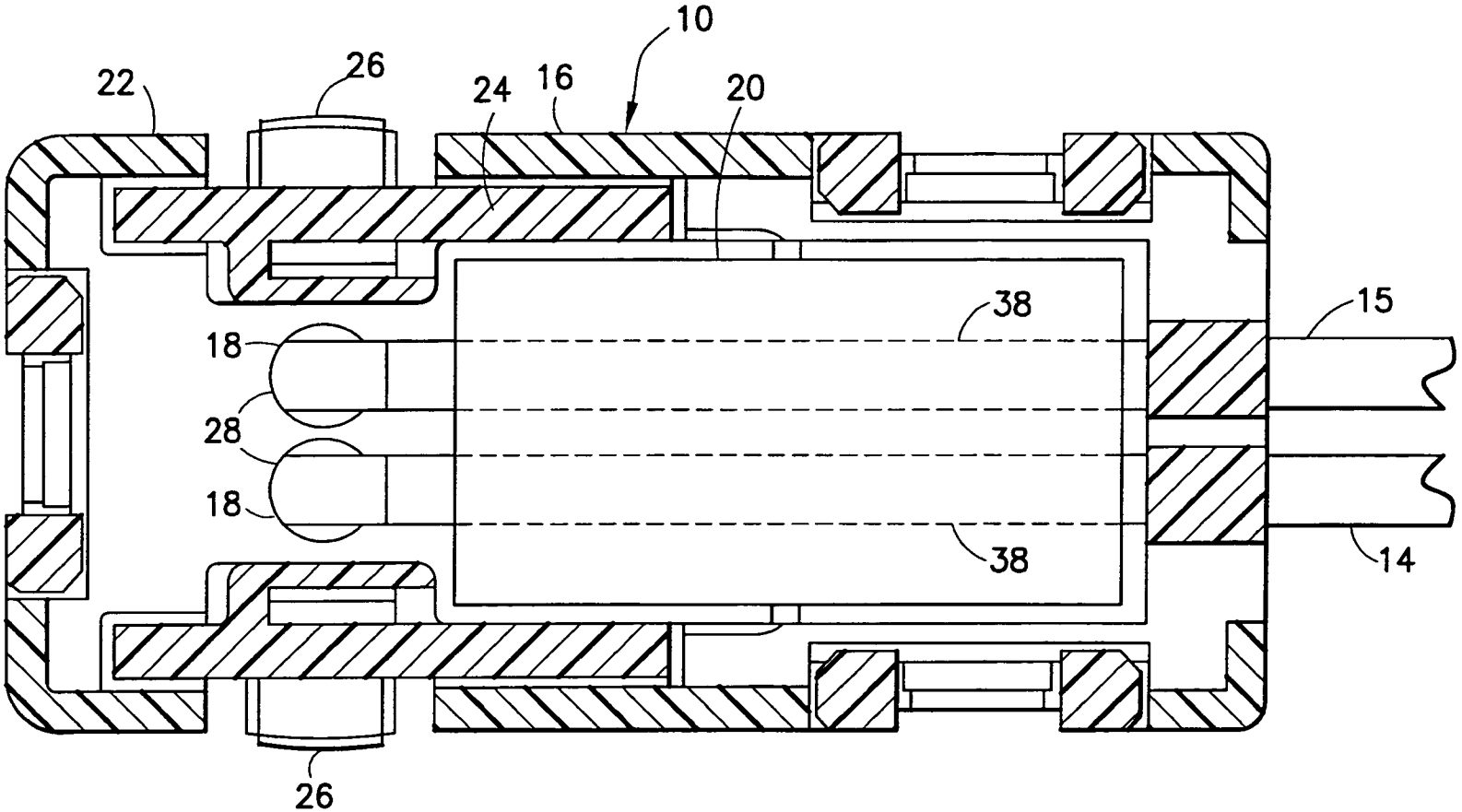
FIG. 2 is a cross-sectional view of the connector shown in FIG. 1.

The connector 10, in this embodiment, is for use in connecting electrical conductors 14, 15 with an initiator 37 in the air bag gas generator 12. Referring also to FIGS. 2 and 3, the connector 10 generally comprises a housing 16, electrical contact terminals 18 and a filter assembly 20 (see FIG. 2). Features of the present invention are intended to prevent an electromagnetic interference (EMI) discharge at an air bag gas generator by filtering electromagnetic induction current in the electrical connector used to connect electrical wires to the gas generator. Features of the present invention can provide an enhanced EMI suppression capability.

The housing 16 comprises a first housing piece or main section 22 and a second housing piece or cover 24. The two housing pieces are preferably comprised of molded plastic or polymer material. However, in alternate embodiments, any suitable material(s) could be used. In an alternate embodiment, the housing could be comprised of more or less than two housing pieces.

The first housing piece 22 includes two cantilevered finger actuatable deflectable latches 26, two separate receiving areas 28, and two holes 30 through a bottom face 32 of the housing into the receiving areas 28. However, in alternate embodiments, the latches 26 might not be provided. Alternatively, any suitable type of latching system could be provided. The housing 16, at the bottom of the front section 34, is adapted to be plugged into a socket 36 of the initiator 37 of the gas generator 12. The latches 26 are adapted to latch with latch surfaces in the socket 36. Optionally, additional connector position assurance means (not shown) can be provided to prevent the connector 10 from accidentally being disengaged from the gas generator 12. The second housing piece 24 is preferably snap lock mounted onto the first housing piece 22 after the contacts 18 and filter assembly 20 are located in the receiving areas 28. However, in alternate embodiments, any suitable type of connection could be provided. In addition, in alternate embodiments, other types of housings or housing components could be provided.

The electrical contact terminals 18 each comprise a first connection section 38, a second female connection section 39, and a positioning section 40. Each first connection section 38 forms a wire connection section for one of the wires 14, 15. However, in alternate embodiments, the terminals 18 could comprise additional sections or sections which are shaped differently from the shapes shown in the drawings. Preferably, the contact terminals 18 are comprised of stamped and formed sheet metal. However, in alternate embodiments, the contact terminals could be comprised of any suitable material (s) and/or could be formed by any suitable contact manufacturing process.

Figure 4:
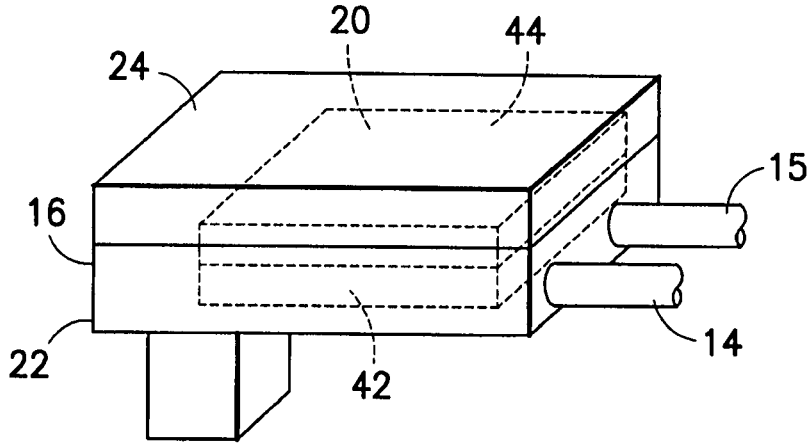
FIG. 4 is a schematic view illustrating location of the ferrite block assembly with the housing members of the connector shown in FIG. 1.
Figure 5:
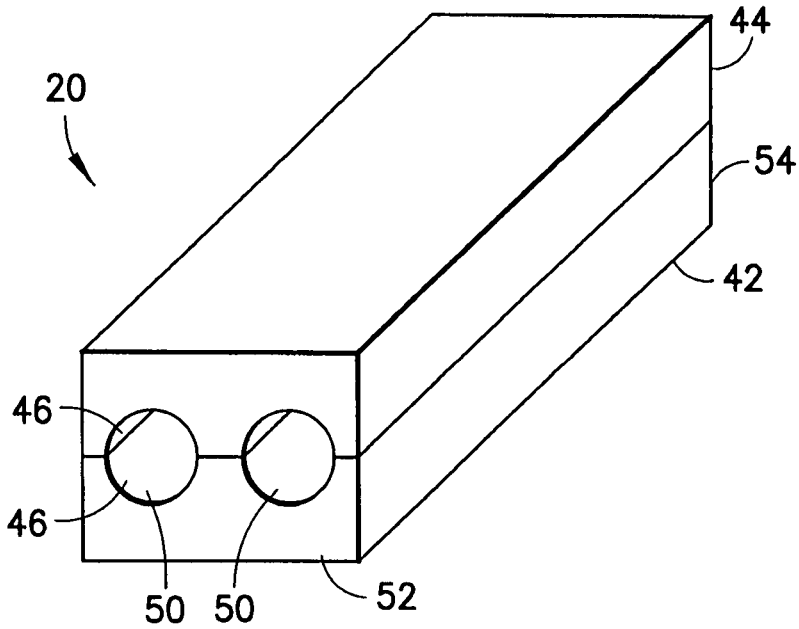
FIG. 5 is a perspective view of the ferrite block assembly shown in FIGS. 2 and 4.
Figure 6:
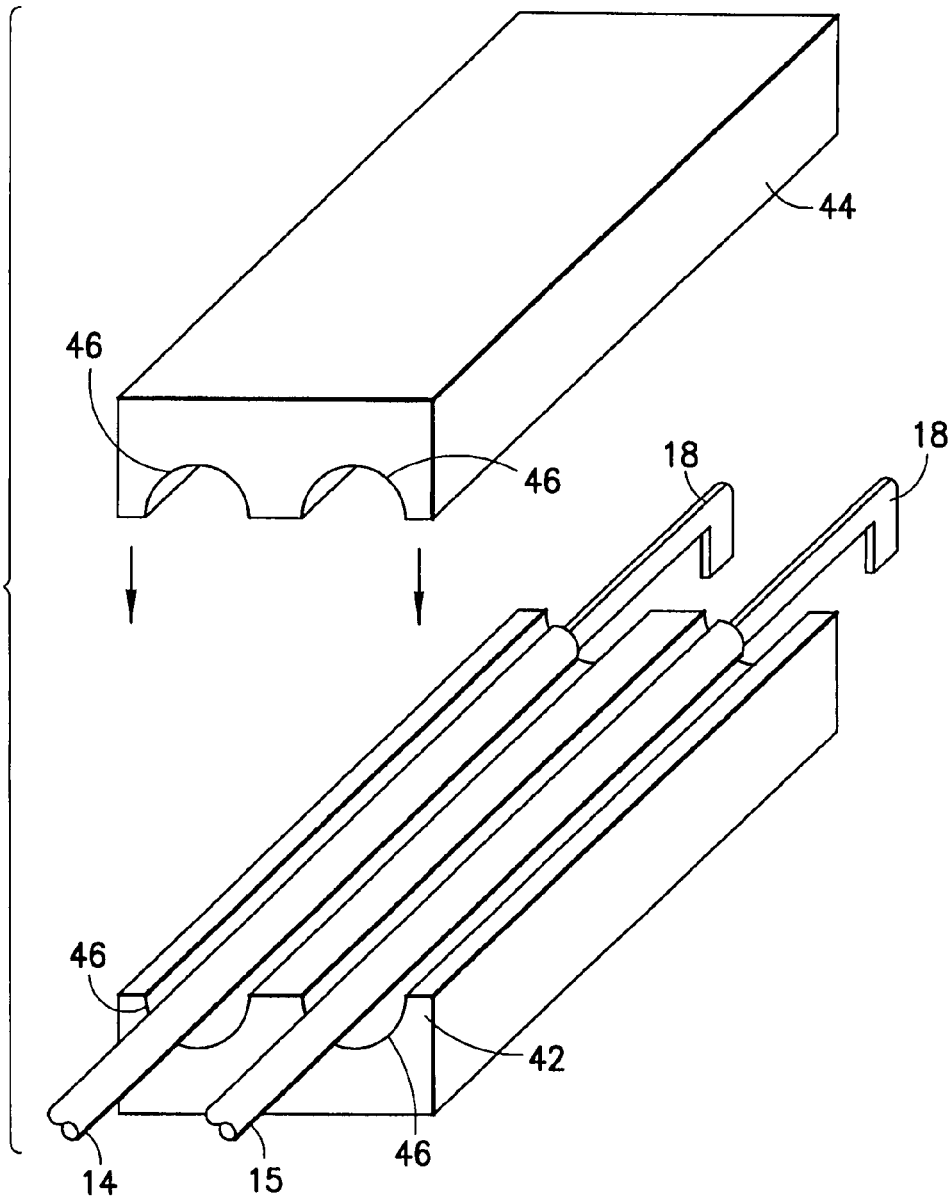
FIG. 6 is a perspective view showing how the ferrite blocks are connected to each other with the electrical conductors and terminals.

Referring also to FIGS. 4-6, in this embodiment the filter assembly 20 comprises a ferrite block assembly. The ferrite block assembly is comprised of electrically non-conductive ferrite oxide. The ferrite block assembly has a general rectangular box shape with two parallel side-by-side holes 50 passing therethrough from a front to a rear of the block. The holes 50 have a general cross-sectionally circular shape along the length of the block. The ferrite block assembly 20 comprises two ferrite blocks 42, 44. In this embodiment the two ferrite blocks 42, 44 are mirror images of each other. However, in alternate embodiments they could be different. Each ferrite block 42, 44 has two generally semi-circular channels 46 along one side between its front and rear ends 52, 54. The top block 44 is positioned on top of the bottom block 42 with the channels 46 aligning with each other to form the two holes 50.

FIG. 4 shows the general location of the ferrite block assembly 20 in the housing. The bottom block 42 is mounted to the main section 22. The top block 44 is preferably mounted to the cover 24. However, the cover could merely function to retain the top block 44 against the bottom block 42 after the top block 44 is positioned against the top side of the bottom block 42. As seen with reference to FIG. 6, portions of the wires 14, 15 and/or terminals 18 are positioned in the conductor channels 46 of the bottom block 42. The top block 44 is then positioned on top of the bottom block 42 and the portions of the wires 14, 15 and/or terminals 18. In the embodiment when the top block 44 is attached to the cover 24, the positioning of the block 42, 44 relative to each other described above could automatically occur when the cover 24 is attached to the main section 22. The semi-circular cross section of the channels 46 cause the blocks 42, 44 to matingly seat against a generally circular cross section of the electrical conductors 14, 15.

The method of assembling an electrical connector can be provided comprising providing a first subassembly comprising the housing main section 22 and a first ferrite block member 42; positioning electrical conductors 14, 15 in first conductor channels 46 of the first ferrite block member 42; positioning a second ferrite block member 44 onto the first ferrite block member 42 to surround portions of the electrical conductors 14, 15 by the first and second ferrite block members 42, 44; and connecting a housing cover 24 to the housing main section 22 to retain the first and second ferrite block members 42, 44 together. As noted above, the second ferrite block member can be provided attached to the housing cover 24, wherein connecting the housing cover 24 to the housing main section 22 positions the second ferrite block member 44 onto the first ferrite block member 42.

Figure 7:
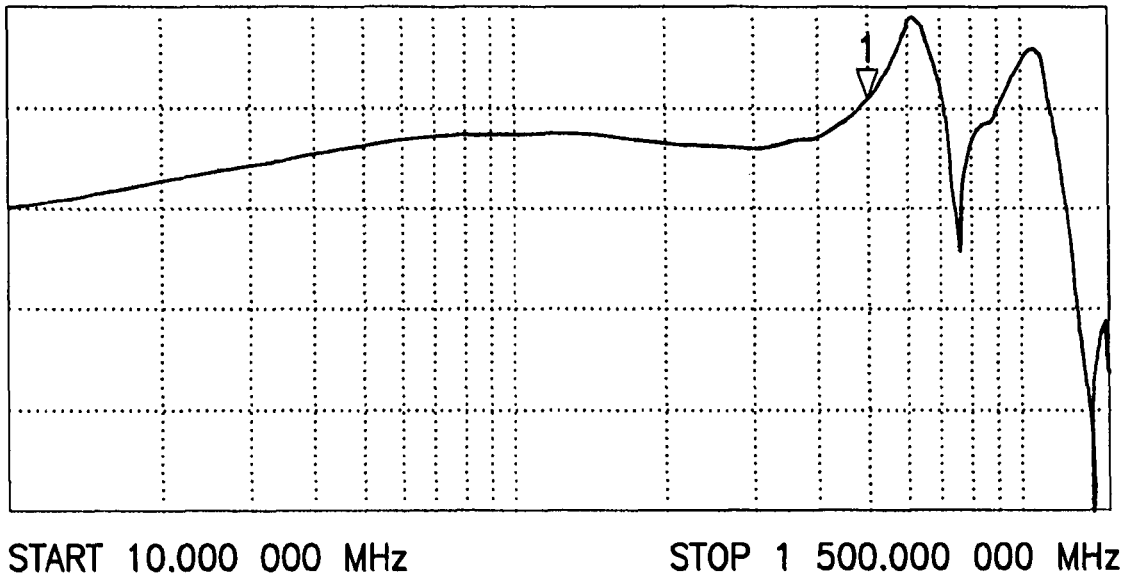
FIG. 7 is a chart showing decibels versus frequency of a connector not having a ferrite block.
Figure 8:
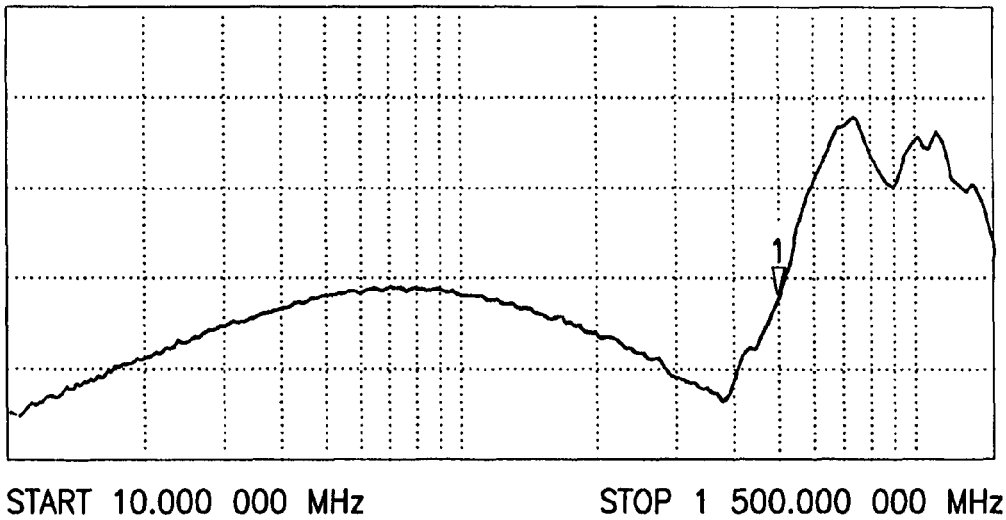
FIG. 8 is a chart as in FIG. 7 showing decibels versus frequency of a connector having the ferrite block assembly shown in FIG. 5.
Figure 9:
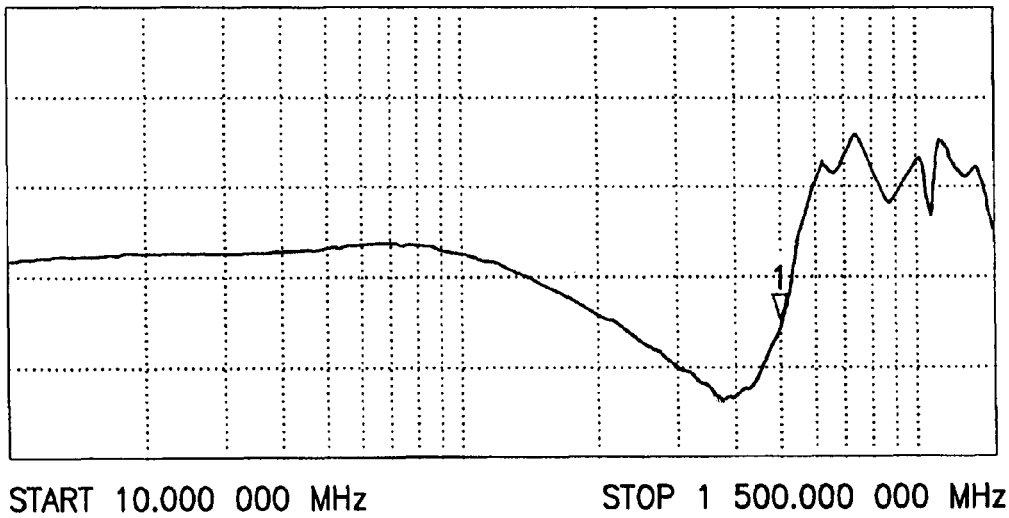
FIG. 9 is a chart as in FIG. 8 showing decibels versus frequency of a connector having the ferrite block assembly shown in FIG. 5 as a unitary member rather than two members.

Referring also to FIGS. 7-9, charts showing decibels versus frequency of different connectors are shown. FIG. 7 shows test results from the connector 10 without the ferrite block assembly 20 installed. This establishes a base-line chart. Point 1 represents −8.7729 dB at 500 MHz. FIG. 8 shows test results from the connector 10 with the ferrite block assembly 20 installed. Point 1 represents −32.097 dB at 500 MHz. FIG. 9 shows test results from the connector 10 with a monolithic ferrite block installed which has the same dimensions and materials as the block assembly 20. Point 1 represents −34.847 dB at 500 MHz. As seen in comparing the charts, it has been discovered that providing the ferrite as two split ferrite members 42, 44 rather than a single monolithic ferrite block can still provide about the same qualities. Thus, it has been discovered that a multi-piece ferrite block assembly can be used rather than a single ferrite block. The multi-piece ferrite block members can be cut from a single ferrite block or formed separately.

This type of electrical connector and method of assembly can make the assembly of the connector faster, and with less risk of mis-assembly of the components. The ferrite block assembly 20 can be provided at the junction of the wires 14, 15 with the terminals 18 if desired. The housing main section 22 and first ferrite block 42 can be provided as a first sub-assembly and the housing cover 24 and second ferrite block 44 can be provided as a second sub-assembly if desired. In alternate embodiments, more than two ferrite blocks could form the ferrite block assembly and they could be comprised of different materials. This invention also allows easy access and removal of the terminals 18 and wires 14, 15 from the ferrite block assembly 20 when the cover 24 is opened, such as for repair of the connector or re-use of the ferrite block assembly in another connector. The housing members 22, 24 preferably retain the ferrite blocks 42, 44 together in an assembly. However, the ferrite blocks could be fixedly attached to each other by additional or alternative means, such as electrically conductive adhesive for example.

Figure 10:
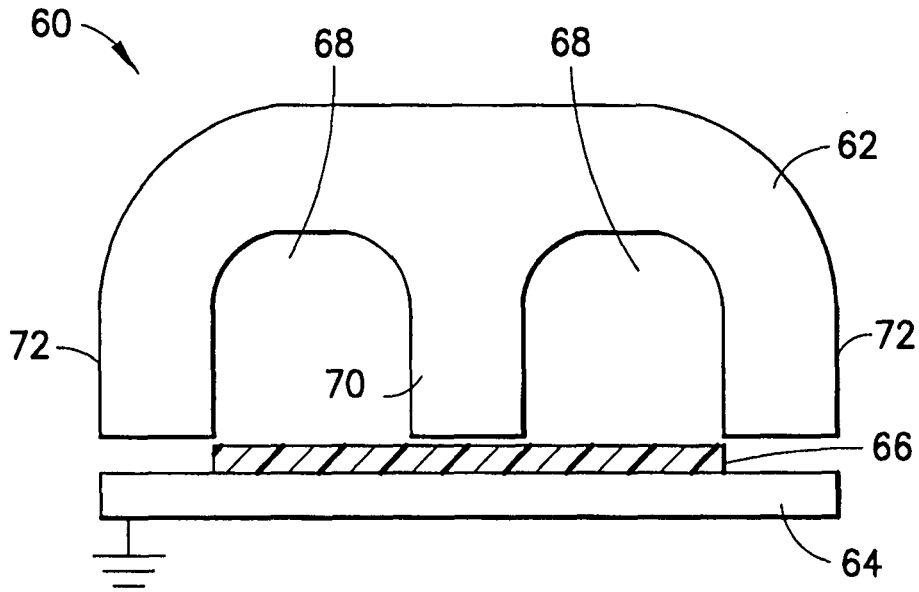
FIG. 10 is an end view of an alternate embodiment of the filter assembly.

Referring also to FIG. 10, there is shown an alternate embodiment of the invention. A filter assembly 60 is shown which can be used in an electrical connector in place of the filter assembly 20. The filter assembly 60 generally comprises a ferrite member 62, an electrical cover conductor 64 and an electrical insulator 66. In this embodiment, the ferrite member 62 has a general "M" shape with two wire conductor passages 68, a center spacer 70, and two side walls 72. The insulator 66 is located on a top side of the electrical cover conductor 64 at the open bottom sides of the passages 68. Thus, the insulator 66 can electrically insulate wire conductors in the passages 68 from the electrical cover conductor 64. The insulator is preferably permanently attached to top side of the conductor 64, but could be a severable member or merely located (and perhaps captured) between the ferrite member 62 and the conductor 64. The ferrite member 62 can be electrically coupled to the conductor 64 such that the conductor 64 can function as a ground, and the assembly 60 function as a filtering capacitor for the wire conductors.

By having the open bottom sides of the passages 68, it is easier to assemble the filter assembly 60 with the wire conductors. More specifically, the wire conductors can be placed on the insulator 66 in a side-by-side orientation, and then the filter member 62 is merely placed on top of the wire conductors with the wire conductors being received in the passages 68. The ferrite member 62 can be electrically connected to the conductor 64. The conductor 64 could be connected to one of the wire conductors as part of the grounding circuit, but is preferably connected to a separate ground circuit. It should be noted that use of terms such as "top" and "bottom" are merely used for reference, and should not be considered as limiting. With this design, once the assembly 60 is connected to the wire conductors, the cover of the connector housing can be attached to the base of the connector housing to hold the assembly 60 and wire conductors together. However, in an alternate embodiment, additional or alternative means for holding the components of the assembly 60 together could be used. In another alternate embodiment, the ferrite member 62 could have a shape other than an M shape so long as the passages 68 have open non-end sides to pass the wire conductors through, and the electrical cover conductor has a suitable shape to subsequently close those open non-end sides. For example, the ferrite member 62 could have an S shape.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing comprising a main section and a cover;

electrical contacts connected to the housing; and a ferrite assembly connected to the housing, wherein the ferrite assembly comprises a ferrite block member, an electrical cover conductor and an electrical insulator, wherein the ferrite block member has a general M shape, wherein the general M shape forms two wire conductor passages adapted to surround portions of electrical conductors connected to the electrical contacts, wherein each passage has an open bottom side, wherein the electrical cover conductor closes the open bottom sides of the passages, and wherein the electrical insulator is located on a top side of the electrical cover conductor at the open bottom sides of the passages between the passages and the electrical cover conductor.

2. An electrical connector as in claim 1, wherein the conductor passages have a semi-circular cross section to matingly seat against a generally circular cross section of the electrical conductors.

3. An electrical connector as in claim 1, wherein the ferrite block member is electrically coupled to at least one of the conductors.

4. An electrical connector as in claim 1, wherein at least one of the conductors is connected to one of the wire conductor passage as part of a grounding circuit.

5. An electrical connector comprising:

a housing comprising a main section and a cover;

electrical contacts connected to the housing; and a ferrite assembly connected to the housing, wherein the ferrite assembly comprises:

a ferrite block member, an electrical cover conductor and an electrical insulator, wherein the ferrite block member has two wire conductor passages adapted to surround portions of electrical conductors connected to the electrical contacts, wherein each passage has an open non-end side, wherein the electrical cover conductor closes the open non-end sides of the passages, and wherein the electrical insulator is located on a top side of the electrical cover conductor at the open bottom sides of the passages between the passages and the electrical cover conductor.

6. An electrical connector as in claim 5, wherein the ferrite block member is electrically coupled to at least one of the conductors.

7. An electrical connector as in claim 5, wherein at least one of the conductors is connected to one of the wire conductor passages as part of a grounding circuit.

8. An electrical connector as in claim 5, wherein the ferrite block member has a M shape.

9. An electrical connector as in claim 8, wherein the conductor passages have a semi-circular cross section to matingly seat against a generally circular cross section of the electrical conductors.

10. An electrical connector as in claim 5, wherein the conductor passages have a semi-circular cross section to matingly seat against a generally circular cross section of the electrical conductors.

11. An electrical connector as in claim 10, wherein the ferrite block member has a center spacer, and two side walls.

* * * * *